US005916250A

United States Patent [19]

Osthues et al.

[11] Patent Number: 5,916,250

[45] Date of Patent: Jun. 29, 1999

[54] PROCESS FOR SETTING THE STATIC SUPERHEATING IN EXPANSION VALVES FOR COOLANT CIRCUITS

[75] Inventors: Josef Osthues, Schorndorf; Michael Kress, Fellbach, both of Germany

[73] Assignee: Honeywell AG, Offenbach, Germany

[21] Appl. No.: 08/793,860

[22] PCT Filed: Jul. 8, 1995

[86] PCT No.: PCT/EP95/02662

§ 371 Date: May 15, 1997

§ 102(e) Date: May 15, 1997

[87] PCT Pub. No.: WO96/07066

PCT Pub. Date: Mar. 7, 1996

[30] Foreign Application Priority Data

Aug. 27, 1994 [DE] Germany ..... P 44 30 497

[51] Int. Cl.[6] ..... F25B 41/04

[52] U.S. Cl. ..... 62/114; 62/225

[58] Field of Search ..... 62/225, 114; 236/92 B

[56] References Cited

U.S. PATENT DOCUMENTS

| | | | |
|---|---|---|---|
| 5,044,170 | 9/1991 | Tanaka | 62/225 |
| 5,127,237 | 7/1992 | Sendo et al. | 62/225 |
| 5,277,364 | 1/1994 | Heffner et al. | 62/225 |
| 5,425,890 | 6/1995 | Yudin et al. | 62/114 |
| 5,499,508 | 3/1996 | Arai et al. | 62/114 |

FOREIGN PATENT DOCUMENTS 0 513 568 A1 11/1992 European Pat. Off. .

*Primary Examiner*—William E. Tapolcai
*Attorney, Agent, or Firm*—Flynn, Thiel, Boutell & Tanis, P.C.

[57] ABSTRACT

To effect the adjustment, the expansion valve is first set for a basic coolant ($R_o$) to a substantially constant static overheating temperature ($\Delta t_{oh}$) in a predetermined working range of the evaporator temperature and, when the coolant circuit is filled with a replacement coolant ($R_1$, $R_2$) differing from the basic coolant ($R_o$), the pretension of its adjusting spring (46) is adjusted in accordance with a specification suited to the difference between the vapor pressure curves of the replacement coolant and those of the basic coolant.

6 Claims, 2 Drawing Sheets

PROCESS FOR SETTING THE STATIC SUPERHEATING IN EXPANSION VALVES FOR COOLANT CIRCUITS

FIELD OF THE INVENTION

The invention relates to a process for setting a static superheating by a thermostatic expansion valve operated by means of a control membrane, which has a condensate inlet, a valve outlet on the evaporator side thereof. The valve outlet is connected to a condensate inlet through a valve seat which can be closed off in a closing direction by a valve member loaded by a pretensioned adjusting spring, and has a control chamber loading the control membrane in a closing position with coolant pressure on the evaporator side of the control membrane, and a control chamber which is arranged on the oppositely lying side of the control membrane and which communicates with a gas chamber of an adsorption thermosensor, which can be thermally coupled to the evaporator output and contains a gaseous adsorbate and a solid adsorbent.

BACKGROUND OF THE INVENTION

In the coolant circuit, the expansion valve causes a throttling of the coolant pressure and achieves the purpose of controlling the superheating of the coolant at the evaporator output with the goal of protecting the compressor connected after the evaporator against nonpermissible liquid contact and to effect a good degree of fill in the evaporator, which degree of fill meets the performance demands. The term "superheating" means the increased heating of the evaporated coolant beyond the evaporation temperature, which can occur only after the complete evaporation of the coolant within the evaporator. Thus by controlling the superheating, it is achieved that the evaporator is supplied with exactly the amount of liquid coolant which it can there completely evaporate due to the supply of heat thereto.

The adsorption thermosensor contains as a control filler a suitable gas or gas mixture as an adsorbate and an adsorbent consisting of a solid material with a large surface area. For example, activated carbon, silica gel or molecular sieves can be considered as adsorbents, whereas mainly $CO_2$ and $CH_4$ are used as an adsorbate. The adsorption of the adsorbate by the adsorbent are temperature dependent within a wide range which has an almost linear pressure/temperature characteristic, which is particularly advantageous for the superheating control with the help of a thermostatic expansion valve.

For an optimum control of a coolant circuit, care must be taken through a structural design of the expansion valve, on the one hand, and the adjustment of the adsorbent fill, on the other hand, that within a pregiven range of operation of the evaporator temperature there results an essentially constant static superheating of a select coolant, for example, 3 to 6 K at the evaporator output. The conventional thermostatic expansion valves are set at the factory for each coolant occurring in actual practice by selecting the mentioned parameters, and are, if necessary, stored until needed.

The coolants R12, R22 and R502, depending on the spectrum of use, have up to now mainly been used in commercial compression refrigeration machines. Of these coolants only R22 will be permitted in the future, and even this one only as a transition solution for a limited time period. The important reason is the—even if only small—ozone decomposing potential of these coolants. The cooling and climate control industries examine, and test in practice therefore a plurality of chlorine-free alternative coolants, which are intended to replace the mentioned standard coolants in the future. Important selection criteria are, aside from the ozone decomposing potential and the direct greenhouse potential, also the energy requirements for operating the coolants (indirect greenhouse effect).

The plurality of the available replacement coolants require, when they are used in refrigeration plants, the use of suitably designed and adjusted thermostatic expansion valves. Up to now these have each been adapted to the individual coolants by the factory, the factory also stored and, when needed, distributed these to the customer. With an increasing number of replacement coolants, of which some were only partly used experimentally, this results, however, in an increasingly vague multitude kept in storage.

Starting out from this, the basic purpose of the invention is to develop a process for setting the static superheating of an expansion valve, which enables with simple means a change over to different coolants.

SUMMARY OF THE INVENTION

The solution of the invention utilizes the knowledge, that the steam pressure characteristic curves of various replacement coolants have a similar course, which can be converted through adaptation of a linear temperature/pressure characteristic curve of an adsorption thermosensor to a different temperature course at the membrane of the expansion valve, which different temperature course differs in the amount, however, is substantially constant in a wide operating range. In order to adjust to a defined static superheating, therefore only the pretension of the adjusting spring needs to be adjusted in a suitable manner to the vapor pressure characteristic curve of the respective replacement coolant. In order to make this possible, it is suggested according to the invention that the thermostatic expansion valve be adjusted for a basic coolant by adapting the composition and amount of fill of the adsorbate and the adsorbent in the adsorption thermosensor and of the membrane dimensions to the vapor pressure curve of the basic coolant and by adjusting a defined tension of the adjusting spring in a pregiven operating range of the evaporator temperature to cause an essentially constant static superheating. The expansion valve adjusted in this manner, when utilized in a coolant circuit filled with a replacement coolant different from the basic coolant, is adjusted with respect to the tension of its adjusting spring in accordance with an adjusting specification adapted to the deviation of the vapor pressure characteristic curves of the replacement coolant and the calibration coolant.

According to an advantageous and practical development of the invention, the tension of the adjusting spring is adjusted by rotation of a screw member acting against the adjusting spring, which rotation is directed and counted in accordance with the adjusting specification.

BRIEF DESCRIPTION OF THE DRAWINGS

The invention will be discussed in greater detail hereinafter in connection with the drawings, in which.

DETAILED DESCRIPTION

Figure 1:
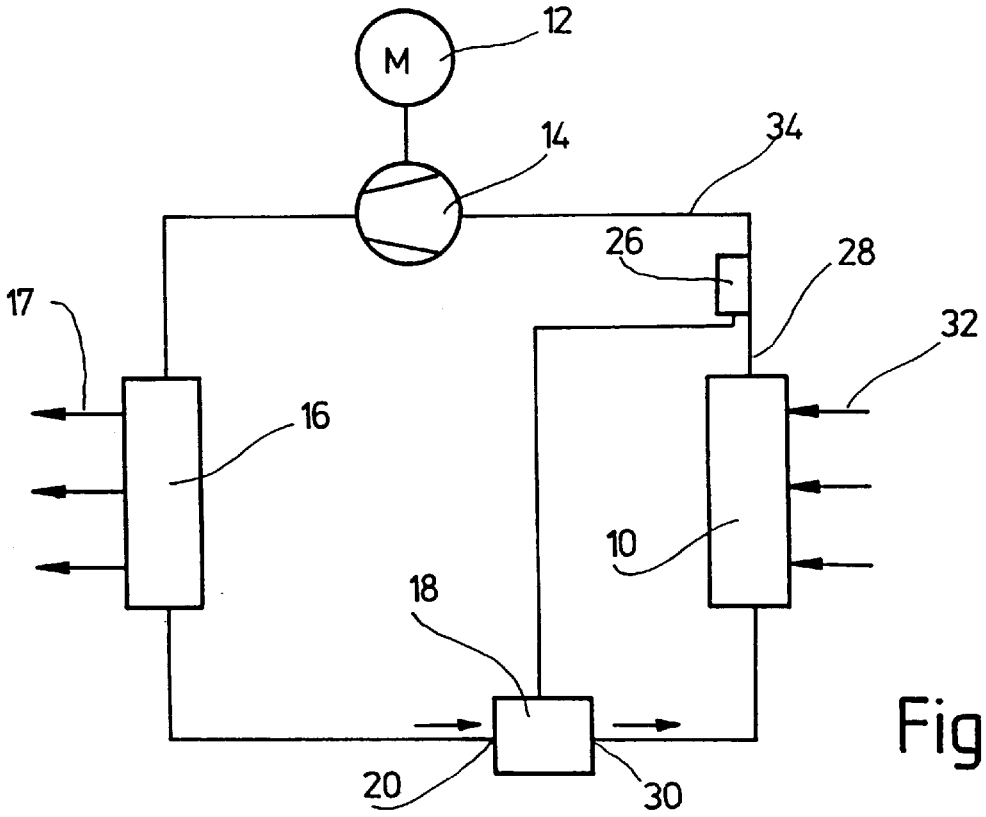
FIG. 1 shows a schematic plan of a refrigeration plant with a thermostatic expansion valve therein.
Figure 2:
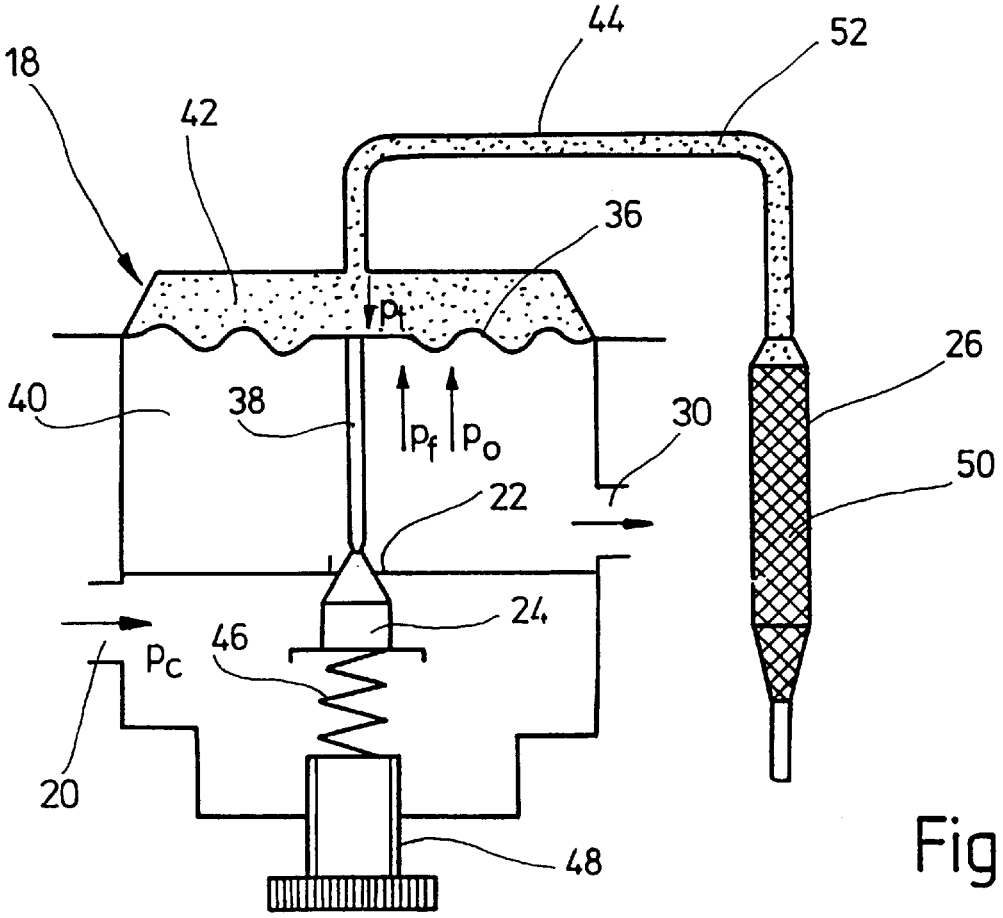
FIG. 2 shows a cross sectional view of a thermostatic expansion valve with an adsorption thermosensor.

The refrigeration plant schematically illustrated in FIG. 1 has a coolant circuit with an evaporator 10, a compressor 14 driven by a motor 12, a condenser 16, a thermostatic expansion valve 18 arranged between condenser 16 and evaporator 10. The gaseous coolant coming from the evaporator 10 is compressed in the compressor 14 and is liquified in the condenser 16 while emitting heat (schematically shown at arrows 17) and enters as condensate under a pressure $p_c$ into a condensate inlet 20 of the expansion valve 18. The condensate is moderated in a throttle member consisting of a valve seat 22 and a valve member 24 in accordance with the temperature measured by the sensor 26 at the output 28 of the evaporator 10 and a pressure $p_o$ existing in the evaporator and is fed through the valve outlet 30 of the expansion valve connected to the evaporator supplying a two-phase, liquid/vaporous mixture to the evaporator 10. The liquid/vaporous coolant is evaporated in the evaporator while absorbing heat (schematically shown at arrows 32) so that only gaseous and superheated coolant exits at the evaporator output 28 and is fed to the compressor 14 through the suction line 34.

The thermostatic expansion valve 18 has the task of feeding the exact amount of liquid/vaporous coolant to the evaporator, which can evaporate based on the heat supply 32 to the evaporator 10. The valve 18 regulates the superheating of the suction gas at the evaporator output 28 and therefore operates as a superheating governor.

The thermostatic expansion valve 18 has for this purpose a control membrane 36 connected to the valve member 24 through a valve tappet 38, and which can be loaded on the valve side of the control membrane through a control chamber 40 with the pressure $p_o$ on the evaporator side of the valve and on the oppositely lying side of the control membrane with the pressure $p_t$ through a control chamber 42 and a capillary line 44 connected to the sensor. The valve member 24 can additionally be loaded in a closing direction by the force of an adjusting spring 46, the initial tension of which can be adjusted by means of a screw member 48. The temperature sensor 26, which is constructed as an adsorption thermosensor, contains an adsorbent 50 consisting of a solid material with a large surface area and a gas filler as an adsorbate 52, which also fills the gas chamber in the capillary line 44, which gas chamber communicates with the sensor and the control chamber 42 while balancing the pressure.

Figure 4:
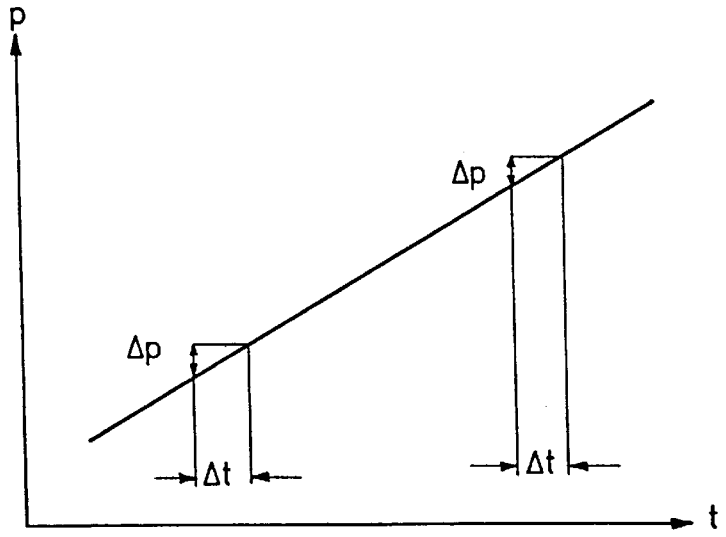
FIG. 4 shows a diagram for the pressure temperature characteristics of the adsorption thermosensor.

Thus, the evaporator pressure $p_o$ of the coolant in the evaporator 10 and the spring pressure $p_f$, which the adjusting spring 46 applies onto the valve member 24, acts on the underside of the control membrane 36. The gas pressure $p_t$ in the thermosensor 26 acts on the upper side of the membrane, which gas pressure is essentially proportional to the sensor temperature at the evaporator output 28 (compare FIG. 4).

Figure 3:
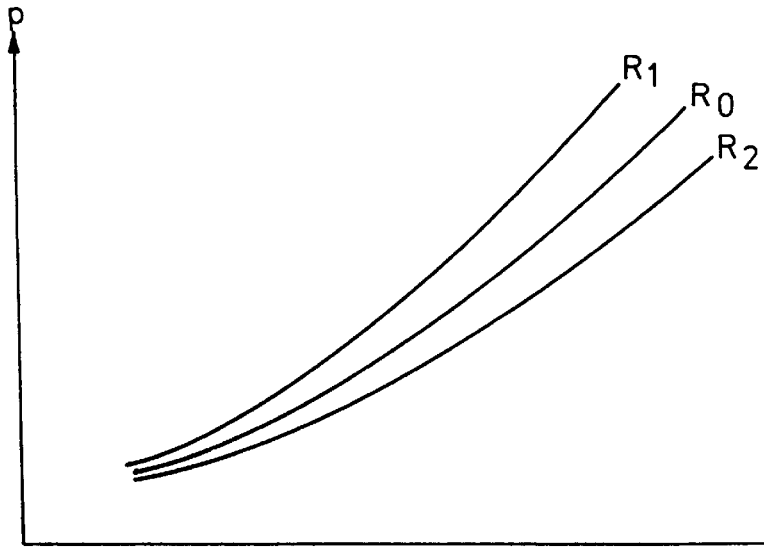
FIG. 3 shows a diagram for the vapor pressure characteristics of various replacement coolants.
Figure 5:
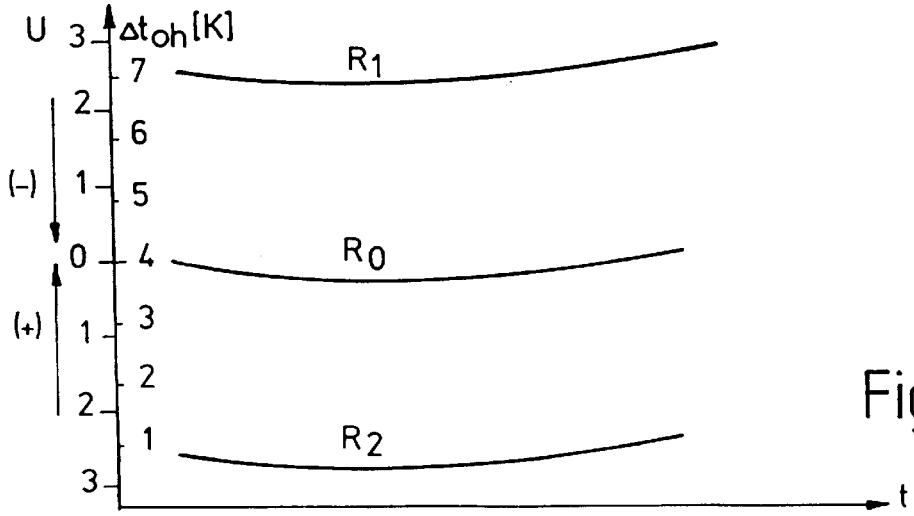
FIG. 5 shows a diagram for the adjusting specification for adapting a preadjusted thermostatic expansion valve to varying replacement coolants.

In order for the manufacturer to set a pregiven static superheating over a given operating range, the expansion valve 18 is built into a test stand, which is loaded with a defined vapor pressure of the basic coolant $R_o$. The adsorption thermosensor 26 is previously filled with the adsorbate in a suitable composition and fill amount at a pregiven feeler temperature corresponding to the membrane dimensions and the vapor pressure characteristic, of the basic coolant $R_o$ and is closed. By adjusting a defined pretension of the adjusting spring, an essentially constant static superheating characteristic $\Delta t_{oh}$ is adjusted in a pregiven operating range of the evaporation temperature, and the adjustment is advantageously marked on the adjusting screw 48. The expansion valve adjusted in this manner can, when inserted into a coolant circuit which is filled with a replacement coolant $R_1$, $R_2$ different from the basic coolant $R_o$, be changed over without any checks on the calibration of the valve in accordance with an adjusting specification adapted to the deviation between the vapor pressure characteristic curves of the respective replacement coolant and the basic coolant. The changeover of the valve occurs advantageously by rotating the screw member 48 in a direction (+/−) and a number of rotations (U) pregiven by the adjusting specifications. The vapor pressure characteristic curves of various coolants $R_o$, $R_1$ and $R_2$ are provided in the diagram according to FIG. 3, whereas the adjusting specification resulting at a pregiven superheating temperature of, for example, $\Delta t_{oh}$=4K, adjusted in the test stand results from the diagram according to FIG. 5. If the adjusting member 48 in the coolant circuit having the replacement coolant is not readjusted, then during operation in the pregiven operating range there would result a nonoptimum, i.e. too great ($R_1$) or too small ($R_2$), static superheating.

In conclusion, the following is to be stated: The invention relates to a process for setting the static superheating in expansion valves within coolant circuits. The setting is done such that the expansion valve is first adjusted for a basic coolant Roto a static superheating temperature $\Delta t_{oh}$, which is essentially constant in a pregiven operating range of the evaporator temperature, and that it is adjusted when using a cooling circuit filled with a replacement coolant $R_o$, $R_2$ different from the basic coolant $R_o$ with respect to the pretension of its adjusting spring 46 in accordance with an adjusting specification adapted to the deviation between the vapor pressure curves of the replacement coolant and the basic coolant.

What is claimed:

1. A process for setting the static superheating in a thermostatic expansion valve having a condensate inlet, and a valve outlet on the evaporator side thereof, which valve outlet is connected to the condensate inlet through a valve seat, said thermostatic expansion valve being operated by a control membrane and closed off in a closing direction by a valve member loaded by a pretensioned adjusting spring, a first control chamber loading the control membrane in the closing direction of the valve member with coolant pressure on the evaporator side, and a second control chamber arranged on an oppositely lying side of the control membrane which communicates with a gas chamber of a closed adsorption thermosensor thermally coupled to an evaporator output of a coolant circuit and containing a gaseous adsorbate and a solid adsorbent, wherein the expansion valve is adjusted for a basic coolant ($R_o$) by adapting the composition and amount of fill of the adsorbate and the adsorbent in the adsorption thermosensor and the mechanical structure and dimensions of the control membrane to the vapor pressure curve of the basic coolant ($R_o$), and by adjusting a defined pretension of the adjusting spring in a pregiven operating range of the evaporator temperature to a generally constant static superheating characteristic ($\Delta t_{oh}$), such that the adjusted expansion valve, when inserted in a coolant circuit filled with a replacement coolant ($R_1$, $R_2$) different from the basic coolant ($R_o$), is adjusted with respect to the pretension of the adjusting spring according to an adjusting specification adapted to the deviation between vapor pressure characteristics of the replacement coolant and of the basic coolant.

2. The process according to claim 1, wherein the pretension of the adjusting spring is adjusted by rotation of a screw member acting against the adjusting spring, wherein the rotation is directed and counted in accordance with the adjusting specification.

3. A process for setting the static superheating in a thermostatic expansion valve, which has a condensate inlet, a valve seat which can be closed by a valve member, the valve member being operated by a control membrane and loaded in a closing direction by a pretensioned adjusting spring, a valve outlet on an evaporator of the valve seat connected to the condensate inlet through the valve seat, a control chamber loading the control membrane in the closing direction of the valve member with coolant pressure on the evaporator side, another control chamber arranged on an oppositely lying side of the control membrane communicating with a gas chamber of a closed adsorption thermosensor which can be thermally coupled to an evaporator output of a coolant circuit, the adsorption thermosensor containing a gaseous adsorbate and a solid adsorbent, the process defined by the following steps:

a) adjusting the expansion valve for a basic coolant ($R_o$) in a pregiven operating range of the evaporator temperature to a generally constant static superheating characteristic ($\Delta t_{oh}$) by:
   selecting the composition and amount of fill of the adsorbate,
   selecting the adsorbent in the adsorption thermosensor,
   selecting the mechanical structure and dimensions of the control membrane to a vapor pressure curve for the basic coolant ($R_o$), and
   adjusting a defined pretension of the adjusting spring;

b) adjusting with the expansion valve set in accordance with step a) with respect to the pretension of the adjusting spring according to an adjusting specification, when the expansion valve previously adjusted in accordance with step a), is inserted in a coolant circuit filled with a replacement coolant ($R_1$, $R_2$) different from the basic coolant (RO);

c) selecting the adjusting specification according to deviation between the vapor pressure characteristics of the replacement coolant and of the basic coolant; and d) adjusting the pretension of the adjusting spring by rotation of a screw member acting against the adjusting spring, which rotation is directed and counted in accordance with the adjusting specification.

4. The process according to claim 1, wherein:

the pretension of the adjusting spring is adjusted by rotation of the screw member in a direction (+/−) and a number of rotations (U) pregiven by the adjustment specification; and the direction (+/−) and number of rotations of the adjustment spring corresponds to the deviation between the vapor pressure characteristics of the replacement coolant and of the basic coolant and the predetermined superheating temperatures ($\Delta t_{oh}$).

5. A process for setting the static superheating in a thermostatic expansion valve for different coolants having different characteristics, the thermostatic expansion valve including a condensate inlet and a valve outlet, the condensate inlet opening to a first chamber, the first chamber having a valve seat opening to a second chamber on an evaporator side of the expansion valve, the first chamber including a valve member pretensioned toward the valve seat by an adjustment spring pretensioned by a moveable member, the process comprising:

(a) adjusting the expansion valve for a basic coolant in a pregiven operation range of the evaporator temperature to a generally constant static superheating characteristic by adjusting the adjustment spring to a defined pretension;

(b) determining an adjusting specification for the adjustment spring according to deviation between the vapor pressure characteristics of a replacement coolant and the basic coolant;

(c) replacing the basic coolant with a replacement coolant different from the basic coolant; and (d) adjusting the pretension of the adjusting spring in accordance with the adjusting specification for the replacement coolant by movement of a member acting against the adjusting spring so that the expansion valve operates at a generally constant static superheating characteristic using the replacement coolant.

6. The process of claim 5, the movable member acting against the adjusting spring comprising a screw member acting against the adjustment spring, rotation of the screw member adjusting the pretension of the adjustment spring, the adjustment specification comprising a specific direction and number of rotations of the screw member.

* * * * *